US008082715B2

(12) United States Patent
Shaw

(10) Patent No.: US 8,082,715 B2
(45) Date of Patent: Dec. 27, 2011

(54) BOTTOM MOUNT FIRE BARRIER SYSTEMS INCLUDING FIRE BARRIER/RETAINER STRUCTURES AND INSTALLATION TOOLS

(75) Inventor: Alan Shaw, Lockport, NY (US)

(73) Assignee: Fireline 520, LLC, Buffalo, NY (US)

( * ) Notice: Subject to any disclaimer, the term of this patent is extended or adjusted under 35 U.S.C. 154(b) by 56 days.

(21) Appl. No.: 12/111,649

(22) Filed: Apr. 29, 2008

(65) Prior Publication Data

US 2008/0263980 A1 Oct. 30, 2008

Related U.S. Application Data

(60) Provisional application No. 60/926,876, filed on Apr. 30, 2007.

(51) Int. Cl.
*E04B 1/68* (2006.01)

(52) U.S. Cl. ..... 52/396.01; 52/396.04

(58) Field of Classification Search ..... 52/239, 52/394, 396.01, 396.04, 396.06, 393, 232, 52/396.02, 749.1, 741.3
See application file for complete search history.

(56) References Cited

U.S. PATENT DOCUMENTS

| | | | | | |
|---|---|---|---|---|---|
| 1,061,424 | A | * | 5/1913 | Swick | 405/119 |
| 3,470,662 | A | * | 10/1969 | Kellman | 52/99 |
| 3,581,450 | A | * | 6/1971 | Patry | 52/58 |
| 4,129,967 | A | * | 12/1978 | Barlow | 52/15 |
| 4,136,707 | A | * | 1/1979 | Gaillot et al. | 137/75 |
| 4,566,242 | A | * | 1/1986 | Dunsworth | 52/396.01 |
| 4,663,894 | A | * | 5/1987 | LaRoche et al. | 52/15 |
| 4,811,529 | A | * | 3/1989 | Harris et al. | 52/396.01 |
| 4,866,898 | A | * | 9/1989 | LaRoche et al. | 52/396.01 |
| 4,914,884 | A | * | 4/1990 | Ohmatsu | 52/396.05 |
| 4,942,710 | A | * | 7/1990 | Rumsey | 52/396.01 |
| 4,977,719 | A | * | 12/1990 | LaRoche et al. | 52/396.01 |
| 5,263,293 | A | * | 11/1993 | Gohlke et al. | 52/396.01 |
| 5,461,838 | A | * | 10/1995 | Heller | 52/396.01 |
| 5,560,166 | A | * | 10/1996 | Burke et al. | 52/218 |
| 5,611,181 | A | * | 3/1997 | Shreiner et al. | 52/396.04 |
| 5,765,332 | A | * | 6/1998 | Landin et al. | 52/396.01 |
| 5,875,598 | A | * | 3/1999 | Batten et al. | 52/396.01 |
| 5,887,842 | A | * | 3/1999 | Granger | 248/548 |
| 6,128,874 | A | * | 10/2000 | Olson et al. | 52/232 |
| 6,499,265 | B2 | * | 12/2002 | Shreiner | 52/393 |
| 2002/0066512 | A1 | * | 6/2002 | Narahara et al. | 152/510 |

FOREIGN PATENT DOCUMENTS

| | | | | |
|---|---|---|---|---|
| JP | 02054044 | A | * | 2/1990 |
| JP | 02289735 | A | * | 11/1990 |
| JP | 05025865 | A | * | 2/1993 |
| JP | 06017489 | A | * | 1/1994 |

* cited by examiner

*Primary Examiner* — Robert Canfield
*Assistant Examiner* — Babajide Demuren
(74) *Attorney, Agent, or Firm* — Patricia M. Costanzo, Esq.

(57) ABSTRACT

Bottom mounted (anchored) fire barrier systems include UL 2079 and ASTM 1399 tested and certified fire barrier/retainer structures, especially useful for floor/floor, wall/floor, and wall/wall expansion joint spaces formed by spaced opposing pre-cast concrete building units of 4½ inches thickness. The use of this system in structures using pre-cast building units provides room for installation of mandated rubber boots into the limited expansion joint space. Each fire barrier has affixed to its outside long edges a metal retainer that is structured for holding the barrier correctly and tightly positioned to the building unit surfaces first for secure and tight anchoring and then for providing support for the barrier to prevent leakage of gas, flame, smoke, and heat during a fire. Providing for ease of installation there is a reusable installation tool, an optional guard unit, male/female connections between barrier sections, and a splice connector butt to connections.

8 Claims, 7 Drawing Sheets

BOTTOM MOUNT FIRE BARRIER SYSTEMS INCLUDING FIRE BARRIER/RETAINER STRUCTURES AND INSTALLATION TOOLS

CROSS-REFERENCE TO RELATED APPLICATIONS

This application claims the benefit of Provisional Application 60/926,876 filed Apr. 30, 2007.

STATEMENT REGARDING FEDERALLY SPONSORED RESEARCH OR DEVELOPMENT

Not Applicable

REFERENCE TO SEQUENCE LISTING, A TABLE OR A COMPUTER PROGRAM LISTING COMPACT DISK APPENDIX

Not Applicable

BACKGROUND OF THE INVENTION

The present invention relates generally to fire barriers and more particularly to fire barriers that are installed into floor to floor spaces created by mandated expansion joints where the installation is required to be from the undersides of the floor sections, retainers that act to support and secure the barrier to the floor so that the barrier maintains its predetermined shape, and tools for installing said bottom mounted fire barriers.

The background information discussed below is presented to better illustrate the novelty and usefulness of the present invention. This background information is not admitted prior art.

Modern building codes require that the stresses experienced by buildings from, for example extreme and/or repetitive changes in temperature, the force of high winds impinging on the building, multi-directional forces due to seismic events, settling of subsoil, building remodels, and excavation on or near the site, must be taken into account in the building design. To accommodate these stresses, buildings must now be constructed with code mandated spaces between wall, floor, and ceiling structural sections. These spaces, referred to as "expansion joints" or "expansion joint spaces" provide for differential building movement without risking damage to the whole structure.

While expansion joints improve the life-time integrity of structures, they also present major risks to the structure. In the event of fire, expansion joint spaces act as chimney flues providing pathways for gases, flame, and smoke to spread rapidly throughout the structure. To counter the flue effect, building codes for commercial structures generally require fire barriers, sometimes referred to as fire stops, to be installed in the expansion joints, as the barriers act to prevent or to reduce the rate of flames and smoke passing through the joints into adjoining areas. Fire barriers offer protection from the effects of fire to both the building and the inhabitants of the building by extending the time available for inhabitants to leave the building and for fire fighters to get to the fire.

During their lifetime, fire barriers, like buildings, undergo stress when a building is subjected to movement, whether from earthquake activity, ground settling, wind, or temperature contraction or expansion. During a fire, building joints and their associated fire barriers are likely to be subject to even greater stress than usual, making it essential that the fire barriers retain their integrity to prevent the migration of gases, flame, and smoke. Accordingly, fire barriers are legally mandated to be tested, rated, and certified. There are two currently mandated tests. One measures the ability of a fire barrier to maintain its structural integrity under compressional and tensional motion. This test is referred to as the "cycle" test and its parameters are specified by ASTM 1399. The other test is referred to as the "fire" or "burn" test and its parameters are specified by UL 2079. The two tests are conducted in sequence. A fire barrier is first cycled between forces of compression and tension 500 times and then, if the barrier passes that test, it is placed into a furnace where it is tested for its ability to resist and prevents flame, heat, and gases from passing through the barrier.

Because all buildings have walls, floors, and ceilings that create corner joints where they meet, two kinds of fire barriers are needed in order to have fire-stop protection in a building: straight-line fire barriers and multi-directional barriers. Until recently, the only fire barriers commercially available and tested were the straight-line, i.e., one dimensional fire barriers. These barriers are made to be installed between the straight segments of walls, ceilings, or floor units that are separated by the mandated expansion joint space. It is expected that straight-line fire barriers are tested and certified.

The importance of correctly installed, tested, and listed fire barrier systems in buildings is increasingly recognized by building officials, owners, insurance companies, contractors, and the public. Moreover, in order to maintain their integrity over their lifetime in a structure, the installation procedures used are also of great importance. As mentioned above, fire barriers are designed to fit into the space created by the expansion joint where the expansion joint is the space between building units, such as between two wall sections, ceiling and wall units, wall and floor units, and floor to floor units. Today, such building units are often constructed from pre-cast concrete, or the like. Pre-cast concrete typically comes in 4½ inches thickness. Thus, for example, two adjacent floor sections of pre-cast concrete provide a depth of 4½ in which to install a fire barrier. This would be difficult under any circumstances as the thickness of the barrier alone is often greater than 4½ inches. Recently, however, fire regulations require a moisture impermeable cover to be placed over the wire barrier, to protect the barrier from damage due to water or other liquids getting to the barrier, such when floors are being washed.

Moisture impermeable covers (referred to in the industry as "boots") are about 4 inches thick. The boots cannot protrude above the floor surface as they would create tripping hazards and would expose themselves to damage. The moisture impermeable covers fill, or nearly fill, the space between the pre-cast floor units, leaving little or no room for a fire barrier or for installation of the fire barrier. Top or outer surface mount installation cannot be used because of the presence of the boot and because mounting devices and associated hardware cannot be protrude above the floor surface. The presence of the boot and the minimal thickness of the pre-cast floor sections eliminate side-mounting of the fire barrier. Thus, what is desperately needed in the art are tested and certified fire barriers that can be bottom-mounted into expansion joint spaces that are about 4½ inch thick, such is found in pre-cast building floor or other units.

To install a barrier so that it is installed tight up against the building structure means that the barrier must be kept tight to the structure until it is securely and fixedly secured. This is a challenge for workers, as barriers are often 10 feet long. What is desperately needed is a way to maintain the barrier positioned against the building structure until the barrier is securely installed.

Another recognized problem in the fire barrier industry is the danger posed to workers while installing fire barriers in expansion joint spaces in high rise buildings. The longer and/or wider a fire barrier, the greater is its weight. It is very hazardous for one, two, or even three workers to have to lift and hold in place until attached heavy fire barriers. Thus, what is also desperately needed is a way to support a barrier in an extension joint space until it is firmly attached.

SUMMARY

The bottom mount (anchored) fire barrier systems of the present invention provide for inserting the fire barrier/retainer units from above or below the floor, for example, through the expansion joint space and anchoring the barrier from beneath the floor and in some cases, where the joint space is wide enough, from inside the joint. The drawings provide examples of retainers designed for use with the straight-line barriers to form fire barrier/retainer structures, as illustrated, although the retainers may also be fitted for use with multi-dimensional fire barriers (the kind that are required for joint junctures involving more than one direction, such as corner joints). It should be understood that the fire barriers of the present invention include floor to floor extension joint spaces as well as floor to wall extension joint spaces. Furthermore, the drawings illustrate and the text teaches fire barriers in the commonly used length of 10 foot straight line barriers. It is to be understood, however, that the retainers and other accessories to be described are intended for use with fire barriers of any length, width, and shape.

Each fire barrier includes in its structure two metal retainers, one affixed to one of the two long sides of the barrier and one affixed to the opposing long side of the barrier. As illustrated in the drawings, each of the retainer parts has a four arm cross-sectional profile. It will be shown that the retainers provide for correctly holding the barrier to the surfaces of the building structure to which they will be affixed to ensure that the barriers are installed and remain tightly positioned against the surfaces. Moreover, after installation, the retainers provide for a barrier to maintain its desired shape and to remain tight to the building units to prevent leakage of gas, flame, smoke, and heat during a fire. Providing for ease of installation of the barrier/retainer into an extension joint space, the invention includes a unique installation tool structured for use only with the fire barriers of the present invention providing first for the barrier/retainer structure to be correctly positioned in relationship to the building units and then maintained in its correct position until the barrier/retainer is securely and fixedly attached to the building structure. Once a fire barrier/retainer structure is fixedly installed into the expansion joint space, the tool is easily and quickly removed and ready for reuse. The invention also includes an optional insulated guard unit designed specifically for the fire barrier system of the present invention that may be installed to provide a protective boundary about the installed fire barrier. Additionally, because whenever a length of straight-line fire barrier is required that exceeds the length of the supplied fire barriers, which is this illustrated is 10 feet, two or more sections of the barrier must be used which at the point of connection the splice point should be strengthened using a splice connector of the present invention, unless the ends are designed to be joined in a male/female fashion, then the use of caulk and intumescent seals the join.

The present invention makes all of these benefits and more possible by providing for a fire barrier system, comprising:

a fire barrier system comprising a fire barrier/retainer structure for bottom mount installation between and onto spaced opposing building units forming an architectural expansion joint space, comprising:

a fire barrier having a length, the length having a width along the length, the width having a first side edge and edge area, an opposing second side edge and edge area, and a mid-section between the first and second side edge areas, the mid-section having a width greater than the width of the joint space, and a two piece fire resistant retainer each piece for attachment to one of the opposing side edge areas of the fire barrier, each retainer comprising:

at least an elongate shank having a length, the length having a width, where the length of the shank is the length of the fire barrier, and the width of the shank is defined as comprising one width part that is the width of the first side edge area of the fire barrier providing for the first width part of the retainer to be attached to the first side area of the barrier and a second width part that is an opposing extension of the first width part and is of sufficient width dimension to extend into the extension joint space to provide a support for an installation tool, creating a fire barrier/retainer structure with opposing rigid side edge areas each for mounting to an underside of the opposing building units forming an expansion joint space.

The present invention further teaches wherein the fire barrier further comprises multi-layers of various fire resistant materials, various fire resistant cloths and/or metallic or other fire resistant materials, wherein the mid-section of a bottom mounted fire barrier is made wide enough to extend beneath the expansion joint space. To provide support and strength to the fire barrier system the invention also teaches wherein the retainer further comprises a stainless steel retainer. Importantly, the fire barrier/retainer structure is designed so that the fire barrier/retainer structure passes UL 20 79 fire and ASTME 1399 cycle tests. To the best of Applicant's knowledge there are no other bottom mount fire barrier/retainer structures that have passed these tests. The present invention further comprises an optional fire-resistant fire barrier protection cover affixed to the undersides of the opposing building units forming the expansion joint space to be positioned about the mid-section of the fire barrier that extends into the space beneath the expansion space.

The present invention further teaches wherein the fire barrier/retainer structure further comprises a fire resistant fire barrier splice line protector cover connector to connect and protect a splice area of abutting fire barrier sections comprising a U-shaped piece of fire resistant material that is shaped to snugly fit over the splice line about the outer surface of the splice. Alternatively, the invention provides for fire barrier/retainer structure that comprises fire barrier end sections comprising male and female splice connecting ends that do not require the splice cover.

Also taught are a choice of fire barrier materials to be used in the construction of the fire barrier, so that, if desired the fire barrier further comprises an outermost fire resistant protective cloth overlain by a sheet of stainless steel foil, a layer of insulation blanket overlaying the stainless steel foil, optionally overlain by a sheet of stainless steel mesh with an optional uppermost layer of intumescent material.

Furthermore each of the retainers may comprise a single elongate shank having a length, the length having a width, where the length is the length of the fire barrier and the width is defined as consisting of a first width part that is the width of the first side edge area of the fire barrier providing for the first width part of the retainer to be attached to the first side area of the barrier and a second width part that is an opposing extension of the first width part and is of sufficient dimension to extend into the extension joint space to provide a lifting support for an installation tool.

The invention contemplates a retainer having a more complex, cross-like structure with a first retainer arm having a length, the length having a width, where the length is the length of the fire barrier and the width is defined as comprising the width of the first side edge area of the fire barrier to be attachable to the length of one side edge area of the barrier, a second retainer arm being an opposing extension of the first arm having a dimension sufficient for the second arm to extend into the extension joint space to provide a lifting support for an installation tool, a third retainer arm of the same length as the first and second retainer arm extending away from and roughly perpendicular to an area defining the junction of the first and second arm to fit snugly against the building unit defining the expansion joint space to keep the fire barrier in a correct position against the building unit, and a fourth retainer arm being an opposing extension of the third arm extending to be in intimate contact to the barrier to provide support to the barrier and to the other arms.

An important part of the system of the present invention is an installation tool for installing the fire barrier/retainer structure into the expansion joint space, the tool comprising:

a handle that may be of the squeeze pistol grip type, comprising:

a stationary handle part and moveable handle part, a connecting rod having a first end and a second end, a stationary upper plate and a rotable lower plate, the handle connected to the first end of the rod, the lower plate connected to the second end of the rod the upper plate connected to the rod spaced from the handle and the second plate, the moveable handle part is squeeze-able toward the stationary handle part to draw the lower plate toward the upper plate or to spread the plates apart from each other, as required.

The rotable lower plate further comprises a series of variously sized plates so that by replacing the lower plate of one size for an analogous plate of another size, the tool may be used to install fire barriers into extension joint spaces of various widths and lengths.

The invention also introduces a method for installing a fire barrier/retainer structure with an installation tool manufactured to be used only with the fire barrier/retainer structure for bottom mount installation between and onto spaced opposing building units forming an architectural expansion joint space herein described, comprising the following steps:

providing a fire barrier/retainer structure, comprising:

a fire barrier having a length, the length having a width along the length, the width having a first side edge and edge area, an opposing second side edge and edge area, and a mid-section between the first and second side edge areas, the mid-section having a width greater than the width of the joint space, and a two piece fire resistant retainer each piece for attachment to one of the opposing side edge areas of the fire barrier, each retainer comprising:

at least an elongate shank having a length, the length having a width, where the length of the shank is the length of the fire barrier, and the width of the shank is defined as comprising one width part that is the width of the first side edge area of the fire barrier providing for the first width part of the retainer to be attached to the first side area of the barrier and a second width part that is an opposing extension of the first width part and is of sufficient width dimension to extend into the extension joint space to provide a support for an installation tool, attaching one of the retainer parts to the first side edge area, attaching the other of the retainer parts to the second side edge area, thus creating a fire barrier/retainer structure with opposing rigid side edge areas each for mounting to an underside of the opposing building units forming an expansion joint space.

and further providing an installation tool as an integral and unique part of the system for installing the fire barrier/retainer structure into the expansion joint space, the tool comprising:

a handle that may be of the squeeze pistol grip type, comprising:

a stationary handle part and moveable handle part, a connecting rod having a first end and a second end, a stationary upper plate and a rotable lower plate, the handle connected to the first end of the rod, the lower plate connected to the second end of the rod, the upper plate connected to the rod spaced from the handle and the second plate, the moveable handle part squeeze-able toward the stationary handle part to draw the lower plate toward the upper plate or to spread the plates apart from each other, as required;

attaching the retainer to the fire barrier creating the fire barrier/retainer structure, positioning the fire barrier/retainer structure into the expansion joint space, positioning the lower plate of the tool so as to support the fire barrier/retainer structure in the expansion joint space, attaching each of the opposing rigid side edge areas to one of the undersides of the opposing building units forming an expansion joint space, and further comprising the step of:

removing the tool from the fire barrier/retainer structure so that it may be reused for the next installation of another fire barrier.

BRIEF DESCRIPTION OF THE DRAWINGS

In order that these and other objects, features, and advantages of the present invention may be more fully comprehended, the invention will now be described, by way of example, with reference to the accompanying drawings, wherein like reference characters indicate like parts throughout the several figures, and in which.

DEFINITIONS

Figure 1:
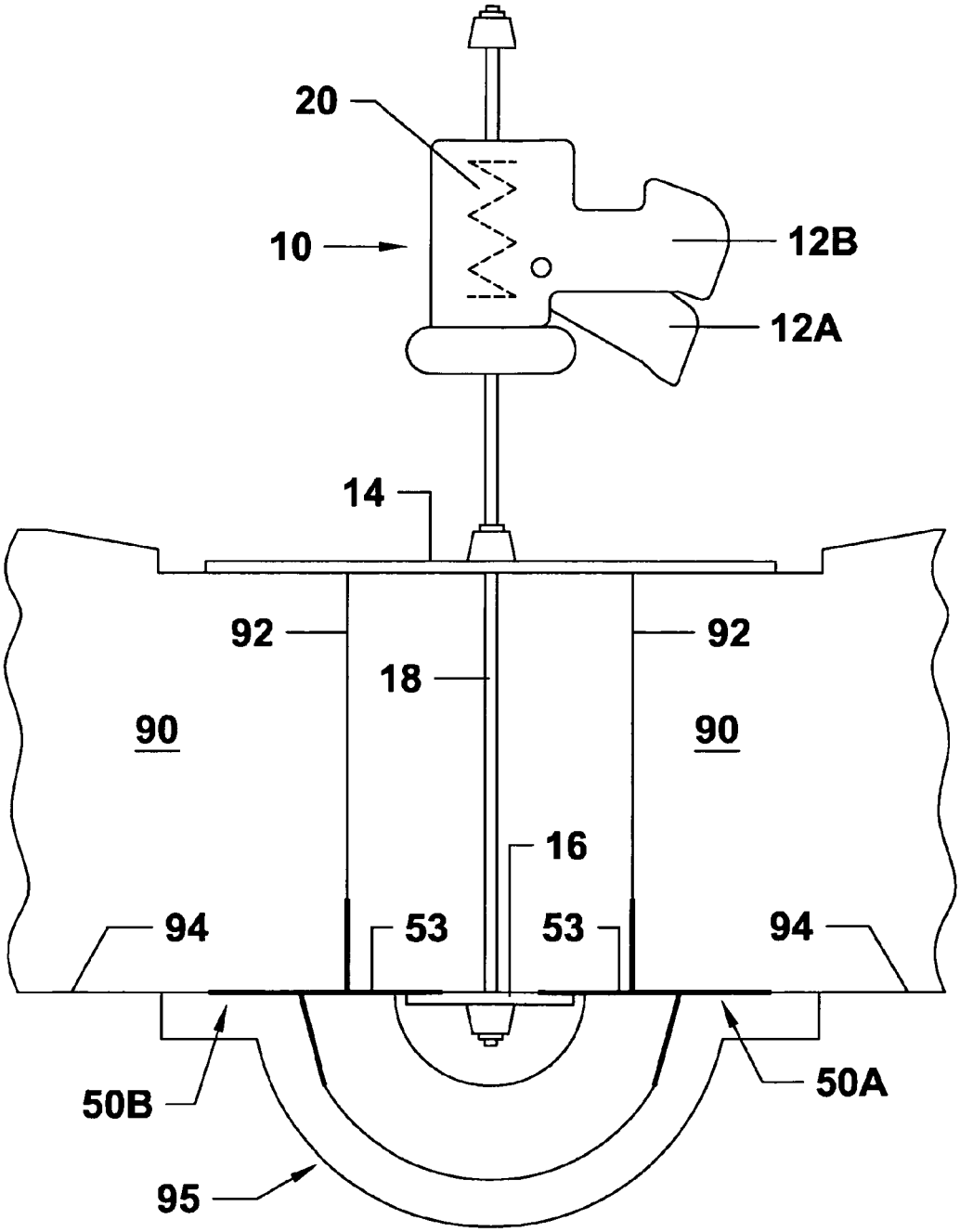
FIG. 1 is a diagrammatic cross-section view of a straight-line fire barrier of the present invention being installed in an exemplary 4½ inch deep expansion joint using size adjustable tool specific for barriers of present invention.

Building units, as used herein, refers to structures such as walls, floors, ceilings, and the like, and may be referred to as structural units.

Fire barrier, as used herein, refers to a structure comprising one or more layers of a fire rated insulation material that is attached to and between opposing, spaced, adjacent building units to span a mandated expansion joint space between the building units, such as an expansion joint space between floor units, wall units, ceiling units, and a combination of units, such as a space created by spaced adjacent floor and wall units.

High-temperature thread, as used herein, refers to any thread that is fire resistant or any thread that will not support combustion, such as a ceramic thread.

Intumescent as used herein, refers to those materials having properties that cause them to expand (or intumesce) to several times their original size when activated by high temperatures to prevent the spread of flames and smoke to other parts of a building, for example passive fire-seals contain intumescent compounds.

Insulation blanket, as used herein, refers to any number of insulation materials, including fiber blankets made from alumina, zirconia, and silica spun ceramic fibers, fiberglass, and the like.

Interdigitate, as used herein, refers to the verb interlock, to be interwoven or to commingle.

Interdigitation, as used herein, refers to the act of interlocking or the condition being interlocked or interpenetrated.

Metallic backing layer, as used herein, refers to fire resistant metal or metallicized foil, such as stainless steel, or the like.

Multi-directional and/or multi-dimensional architectural expansion join or joint, as used herein refers to any joint that is formed by the convergence of more than two structural units, such as the convergence of three wall units or two walls and a floor unit. These joints create spaces between building units that act like chimney flues carrying gases, hot air, flame, and smoke throughout a structure.

Multi-directional and/or multi-dimensional fire resistant barrier, as used herein, refers to any fire barrier that is shaped to functionally fit into a multi-directional and/or multi-dimensional architectural expansion joint.

Protective cloth, as used herein, refers to a flexible, strong, protective, fire-resistant material that is designed to mechanically support the insulation material and to protect the insulation material from mechanical damage, as the insulation is mechanically weak and can be easily damaged by tearing or ripping either accidentally or intentionally during or after installation thus largely compromising the integrity of the fire resistant barrier. The fire resistant layers, such as a layer of insulation material together with a layer of intumescent material, can freely move with respect to the one or more protective layers or they may be attached together via threads or other attaching means. Protective cloths may be manufactured from continuous filament amorphous silica yarns, polymeric material, fiber reinforced polymeric material, high-temperature resistant woven textiles, or a metalized, fiberglass cloth, among others. Metalized cloth may include fibers of stainless steel, aluminum, or copper, for example. Protective materials may also include metal foils or metal screens. Protective cloths also include cloths that are woven to provide for shear, including lateral, motion.

Seaming, as used herein, refers to connecting one part to another part, for example where a cloth is folded and the two parts of the cloth that have been brought together by the folding are subsequently "seamed" together along a predetermined line. The seaming may utilize stitching, using an adhesive, stapling, pinning, or any other means that will connect the two parts to each other.

Spreader, also referred to as press plate, as used herein, refers to any implement or apparatus for applying a pushing force directly to a generally stationary object upon which pressure or tension is to be exerted. It comprises jacks (including lifting jacks, floor jacks, and analogous implements), extracting apparatus (including stump pullers and nail extractors), tensioning apparatus (including belt, carpet and wire stretchers), hoist trucks, and cable-type load hauling or hoisting apparatus, and pressure plates under spring tension including torsion springs.

Strapping, as used herein, refers to off-the-shelf fire-resistant strapping used in construction and fabrication for holding, binding, and/or attaching, such as commonly available steel strapping.

Structural unit, as used herein, refers to such constructs as a wall, floor, ceiling, or the like and may be referred to as building units.

Structure, as used herein, refers to something made up of a number of parts that are held or put together in a particular way.

Tri-dimensional, as used herein, refers to either an expansion joint that has three member parts, such as a T-shaped expansion joint where the T-joint is made up of three co-joint-arms or to a fire barrier that is functionally shaped to accommodate a T-shaped joint.

Tests:

Fire testing per UL 20 79

Cycle test ASTME 1399 (expansion, compression test)

A LIST OF THE REFERENCE NUMBERS AND RELATED PARTS OF THE INVENTION

10 Installation tool.
12 Handle having a trigger like mechanism.
12*a* Moveable upper handle arm.
12*a* Stationary lower handle arm.
14 Upper plate.
16 Lower plate available in a variety of sizes.
18 Connecting rod.
20 Spring
30 Fire resistant caulk.
50*a* A first retainer part.
50*b* A second retainer part situated opposite first retainer part 50*a*.
52 Arm of retainer extending above floor unit.
53 Arm of retainer extending horizontally into expansion joint space.
54 Arm of retainer extending under floor.
55 Arm of retainer extending vertically
90 A floor building unit.
92 Side walls of floor units 90 facing expansion joint space.
94 Bottom surfaces of floor units 90.
95 Fire barrier.
100 Installation blanket.
102 Mesh.
104 Protective cloth.
106 Foil.
110 Intumescent strip material.

150 Attachment means.
160 Attachment means.
200 Optional fire barrier guard protection device.
202*a* A section of two part angular s-shaped fire resistant guar protection device.
202*b* A section of two part angular s-shaped fire resistant guar protection device.
204*a* Upper arm of each angular s-shaped section 202*a*.
204*b* Upper arm of each angular s-shaped section 202*b*.
206*a* Lower arm of angular s-shaped section 202*a*.
206*b* Lower arm of angular s-shaped section 202*b*.
208 Optional blanket.
209 Splice connection line.
300 Splice connector.
302 Fire barrier section.
304 Fire barrier section.

DETAILED DESCRIPTION

Referring now to the drawings which illustrate exemplary versions of the tested and certified fire barriers/retainer structures and the installation tools that are contemplated by this invention, it is shown how the above discussed disadvantages have been overcome. It should be noted that the disclosed invention is disposed to fire barrier/retainer structures in various sizes, such as a variety of lengths, widths, depths, which all depend on the width, depth, and length of the mandated expansion joint spaces, in addition to variation in shapes, contents, layers, materials, and attachment means, as are discussed below. Therefore, the versions described herein are provided with the understanding that the present disclosure is intended as illustrative and is not intended to limit the invention to the versions described.

FIG. 1, a diagrammatic cross-sectional view, illustrates exemplary straight-line fire barrier/retainer structure 75 of the present invention. Fire barrier/retainer structure 75 is illustrated in the process of being bottom mounted (anchored) into an exemplary 4½ inch deep floor/floor architectural expansion joint space created by adjacent spaced cast-concrete floor units 90. Note that by being mounted below the floor, there is adequate space in the expansion joint for the required rubber boot to be installed. Fire barrier 95 is manufactured with retainer parts 50*a* and 50*b* as part of its structure and, thus, is provided from the manufacturing facility as a ready to install unit. The usually elongate fire barrier has two opposing long sides, whose side areas provide the attachment areas to attach the fire barrier/retainer to building units, and a center portion or mid-section between. Retainer 50 comprises first retainer part 50*a* that is affixed to the first long side of the fire barrier, and second retainer part 50*b* affixed to the second long side of the fire barrier to form the fire barrier/retainer structure for bottom mounting into an expansion joint space. In the illustration, each of the retainer parts is designed having a four arm cross-sectional profile. To a first retainer arm one long side of the barrier is fixedly attached. Attaching the fairly rigid retainer to the flexible fire barrier provides for the barrier to be held tightly against the bottom surface of the floor unit providing for a tight and secure attachment (as illustrated). Another arm, which is actually an opposing extension of the first arm, protrudes into the extension space to provide a lifting support for the installation tool, as explained below. A third arm fits closely to the vertical wall of one of the units forming the expansion joint and acts in concert with the other arms to keep the fire barrier is a correct position tight against the building unit surface 92. The fourth arm, an opposing extension of the third arm, provides addition support for the fire barrier and supports the function of the other arms. As illustrated (this structure may be better appreciated by looking at FIG. 2*a*), the fire barrier of the fire barrier/retainer structure 95 has a first long side with a retainer attached and an opposing second long side with a second retainer attached. Additionally, FIG. 1 illustrates in diagrammatic form the parts and working principles of the installation tool. To ensure proper installation of the fire barrier/retainer structure, installation tool 10 is used. Tool 10, as illustrated in FIG. 1 may be of the squeeze/spreader pistol grip type, consists essentially of squeezable handle 12, connecting rod 18 having a first end and a second end, and two plates, upper plate 14 and lower plate 16, which can be squeezed toward each other or spread apart from each other, as required. Handle 12 has two handle parts, stationary handle part 12*b* and moveable handle part 12*a*. Lower plate 16 is shown detachably attached to first end of connecting rod 18. Plate 16 may be either rotably attached to connecting rod 18 or may be connected to rod 18 so that rotating rod 18 provides for the rotation of plate 16. Plate 16 is available in a variety of sizes so that by replacing plate 16 of one size for an analogous plate of another size, the tool may be used in the installation of fire barriers that fit into extension joint spaces of various widths and lengths. The tool shown in the figure is generally for use with fire barriers from 2-10 inches wide. Spaced from lower plate 16, connecting rod 18 passes through an aperture in upper plate 14, so that the second end of connecting rod 18 extends to handle 12 to be slidably attached through and to handle 12. Squeezing the handles of the tools, provides for plates 14 and 16 to be compressed towards each other, which action, when the tool is positioned as illustrated in FIG. 1 pulls the fire barrier/retainer structure tight to the building units to which it will be attached providing for a attachment that is more secure than could be achieved without the tool. The tool also relieves installers from physically supporting the fire barrier/retainer structure at the same time they are attaching the structure to the building units. Activating the release of the tool handle provides for plates 14 and 16 to be extended apart from each other providing for removal of the tool when the attachment of the barrier/retainer structure is complete. The tool is then ready for use in the installation of another barrier. This type of controlled compression and extension action is known in the art and need not be described further here. It has not been known however to design such a compression/extension tool so that its principles may be used to support fire barrier/retainer structures during installation. It is to be understood, that the type of spring controlled compression and extension described here is only one way of providing for the separation and bringing together of plates 14 and 16. Means to achieve compression and extension of such as plates 14 and 16 are also well known in the art. Therefore, it is to be understood that any of the known or yet to be known means that will accomplish the task of extending and compressing the two plates relative to one another, are contemplated for use with the invention. Plate 16 has a width and length, where the length is of greater dimension than the width. The rotation of plate 16 so that the axial length of the plates is parallel to the axial length of the expansion joint space provides for plate 16 to be easily inserted into the expansion joint space so that the plate is at an elevation that is below the level of flange-type arms 53. Once plate 16 is positioned just below flange-type arms 53 of retainer 50, plate 16 is rotated so that the length of the plate is transverse to the expansion joint space providing for plate 16 to extend beneath arms 53, as illustrated, of the retainer providing for the compression of plate 16 relative to plate 14 to provide support to the barrier/retainer structure until each of the two opposing sides of the barrier/retainer are each fixedly anchored to one of the spaced bottom surfaces 94 of floor units 90. Note that when the barrier/retainer structure is in position in the joint space, the width of the center portion or mid-section of the fire barrier extends in a drape-like fashion into the space below the expansion space providing for the extra width needed whenever the expansion joint expands. Without this precaution, the fire barrier could be in danger of being torn apart or having one or two of the affixed long sides of the barrier pulled away from the building unit surface to which it is attached.

The barrier/retainer may be fixedly mounted to the bottom of the floor units by any desired fixation attachment means, such as by use of a nail gun. A nail gun or nailer is a type of tool used to drive fasteners into a material that is usually driven by electromagnetism, compressed air, or, for powder-actuated tools, a small explosive charge. One example of such a nail gun is a Hilti gun that inserts fasteners through the barrier/retainer into the pre-cast concrete floor in the present example.

Once the barrier retainer is fixedly mounted to the bottom surface, plate 16 is again rotated so that the long axis of the plate is again parallel to the long axis of the expansion joint space providing for removal of the plate from the expansion space. The expansion space is now ready for the boot to be installed completing the installation of a bottom mount fire barrier/retainer structure and protective boot.

Figure 2:
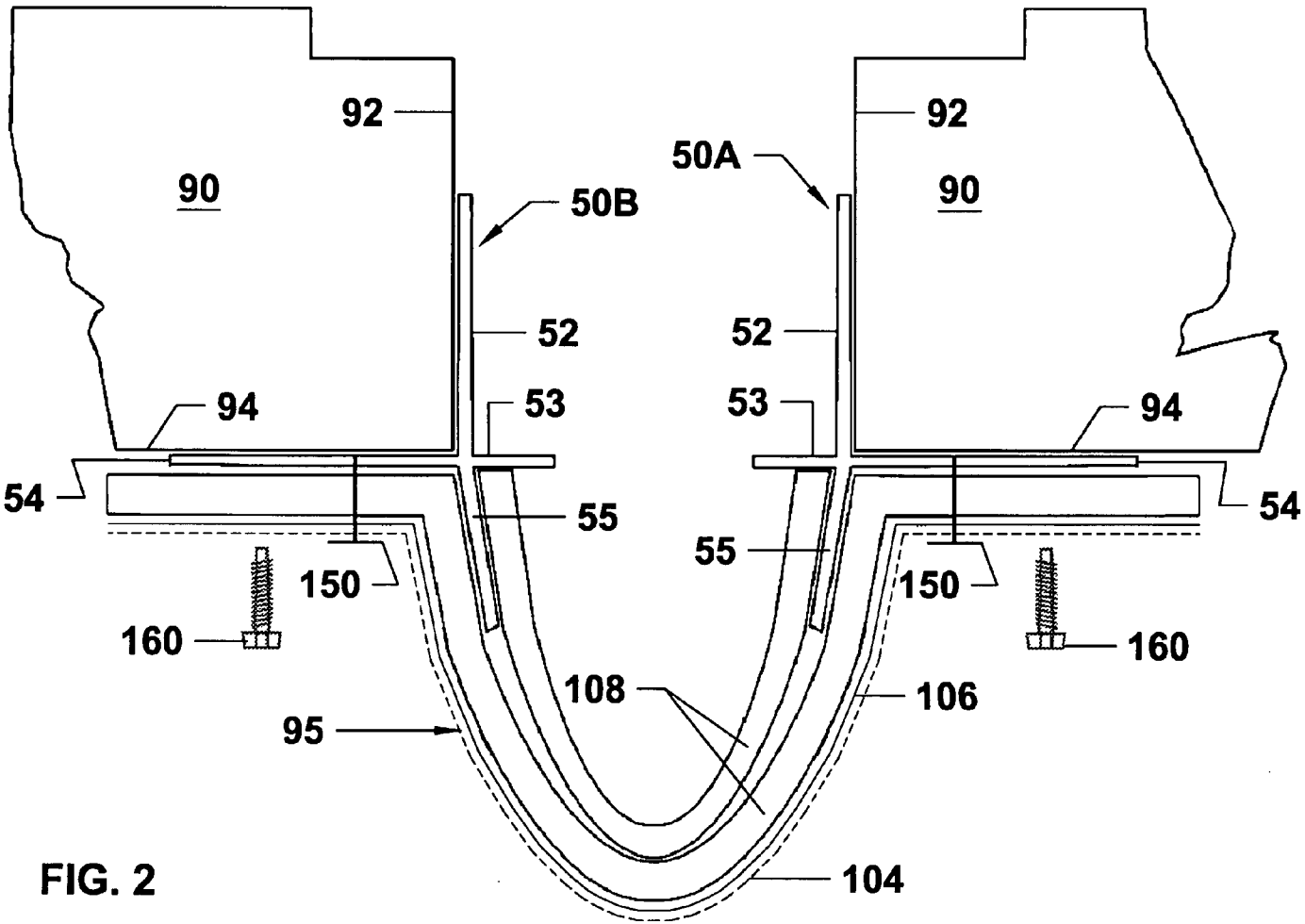
FIG. 2 is a more detailed diagrammatic cross-section view of a straight-line fire barrier of the present invention installed in a 4½ inch deep expansion joint.

Although some barrier/retainer structures may be inserted into the space from either above the floor units or from below, the installation will be described, herein, as a below-the-floor or bottom-mount installation and anchoring, because the barrier will be anchored to the building unit from beneath the floor. Referring to FIGS. 1 and 2, to install a barrier from the space available below the floor units, an installer lifts the barrier/retainer into place so that arms 52 of retainers 50A and 50B are positioned against side walls 92 of floor units 90 and arms 54 of retainers 50A and 50B are positioned adjacent to bottom surfaces 94 of floor units 90. At this point, installation tool 10 is employed to support the barrier/retainer structure tightly and securely in position until fixed attachment of the barrier/retainer structure to the floor units is complete.

Figure 2A:
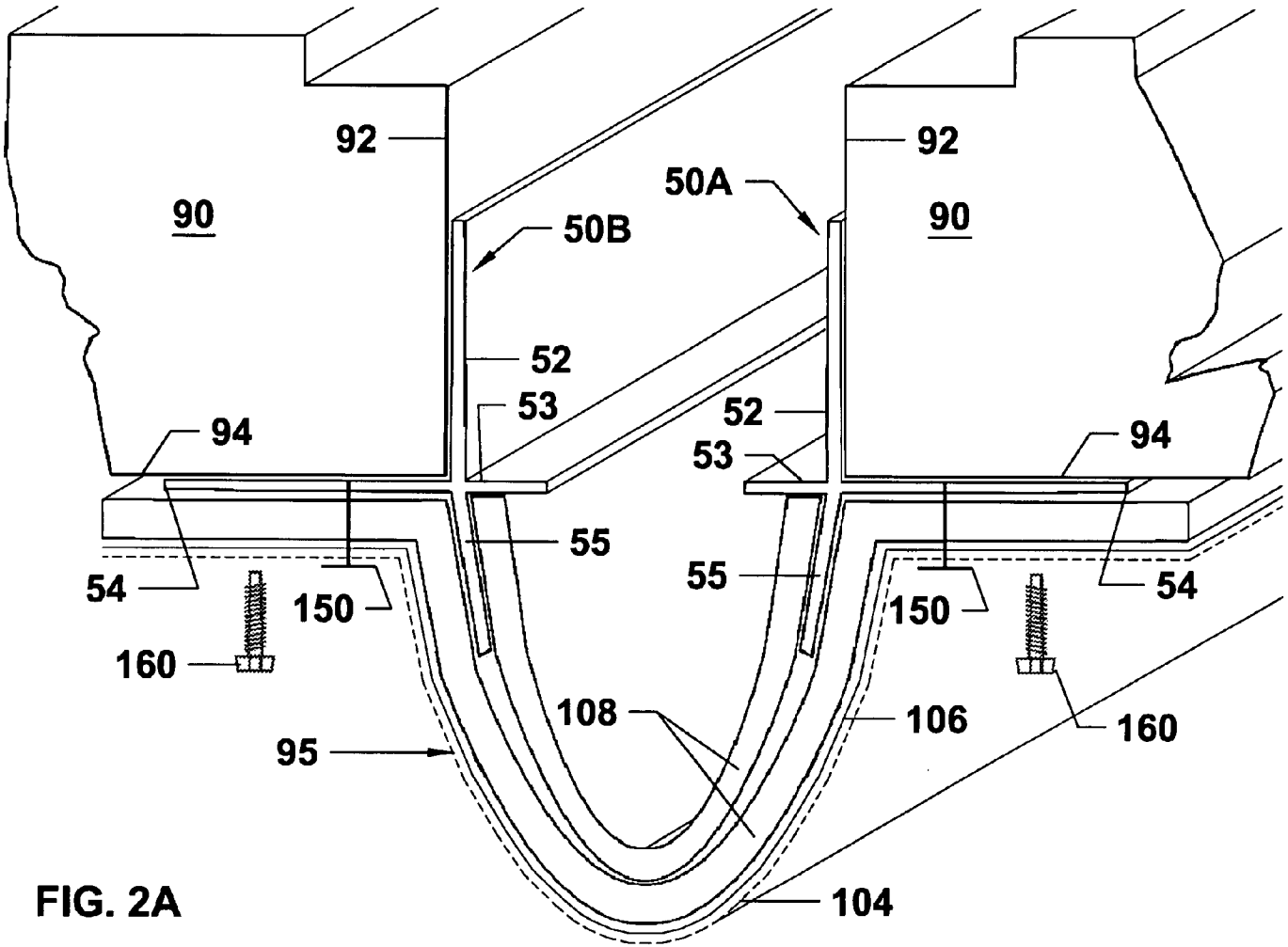
FIG. 2*a* is a perspective diagrammatic cross-section view of a straight-line fire barrier of the present invention installed in a 4½ inch deep expansion joint, as shown in FIG. 2.

FIG. 2, a diagrammatic cross-section view, and FIG. 2*a*, a perspective diagrammatic cross-section view, illustrate more details of a straight-line fire barrier of the present invention installed in a 4½ inch deep expansion joint. In this embodiment, the fire barrier comprises multi-layers of various fire barrier materials with each of retainers 50A and 50B comprising a four arm cross-sectional profile having arms 52, 53, 54, and 55 attached to each the opposing long sides of the barrier. The fire barrier of the barrier/retainer structure, as illustrated, comprises from the outer face of the barrier inward, protective cloth 104 followed a sheet of stainless steel foil 106 followed by a layer of insulation blanket 108 followed by an optional sheet of stainless steel mesh (not shown). Other versions of the fire barrier are contemplated, including those with fewer or a greater number of layers and of a variety of the kinds of layers. The multi-layer fire barrier as described is fixedly attached to the retainer at the time of manufacture. There are many attachment means that may be used to attach a fire barrier to the retainer and all are contemplated for use with the present invention. One example of such attachment means are tack-weld pins 150.

Figure 3:
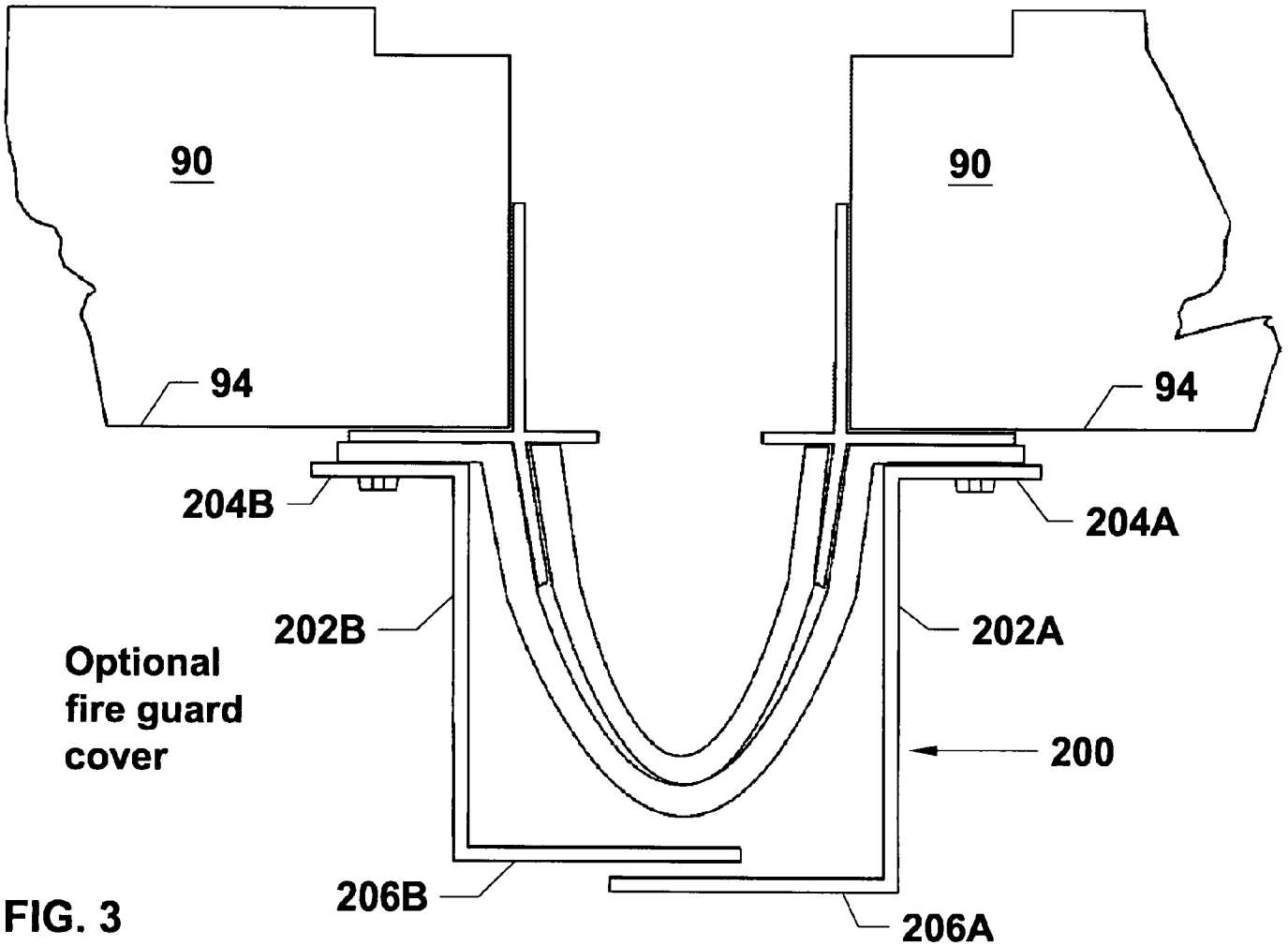
FIG. 3 is a diagrammatic cross-section view of a straight-line fire barrier of the present invention installed in a 4½ inch deep expansion joint illustrating optional fire barrier guard protection devices.
Figure 4:
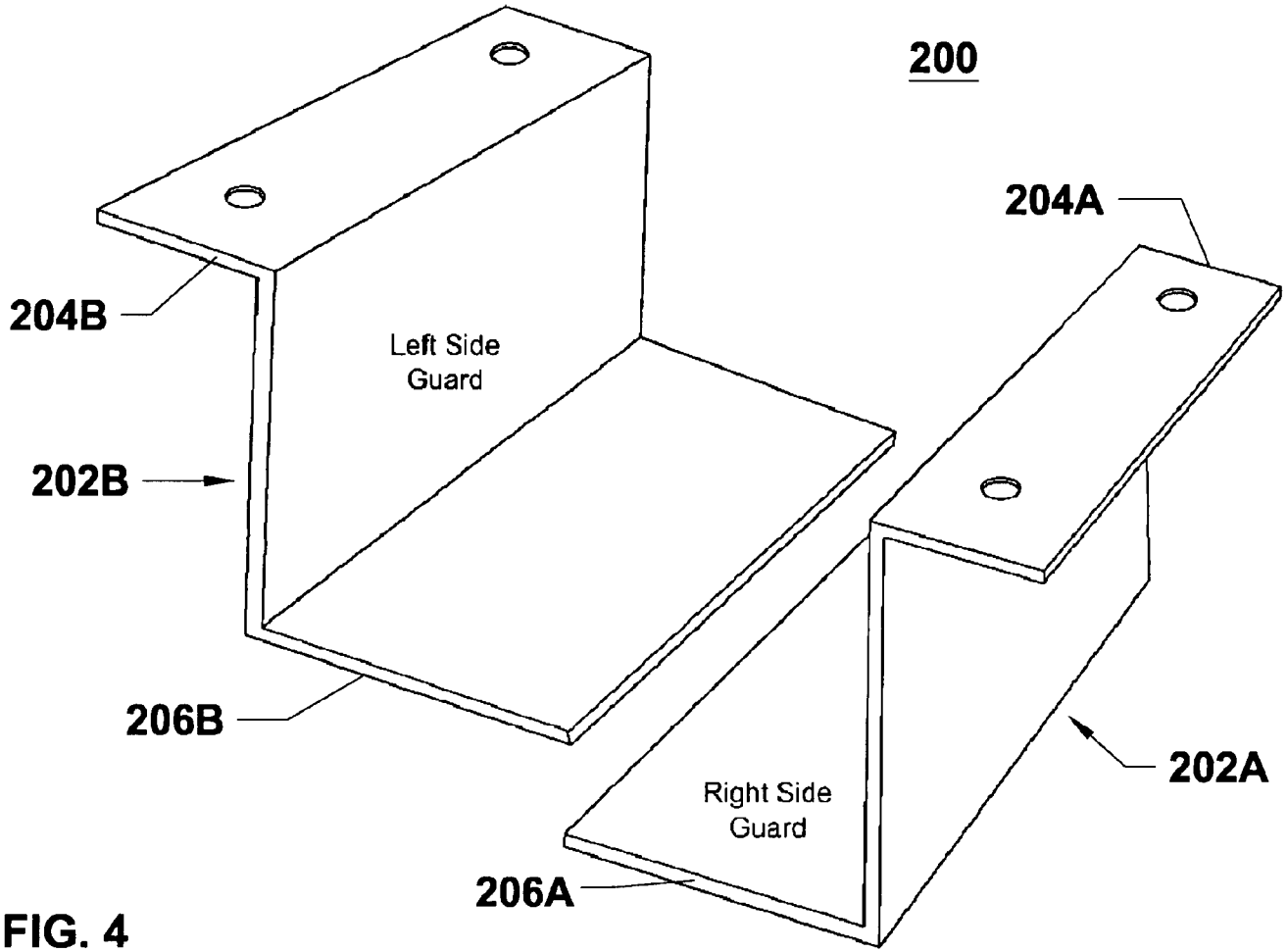
FIG. 4 is a perspectives view of an optional fire barrier guard protection devices according to the principles this invention.

FIG. 3, a diagrammatic cross-sectional view, illustrates a straight-line fire barrier of the present invention installed in a 4½ inch deep expansion joint with the addition of optional fire barrier guard protection device 200. Device 200 in this embodiment comprises two sections of angular s-shaped fire resistant barriers 202*a* and 202*b*. Upper arm 204*a* and upper arm 204*b* of each angular s-shaped section 202*a* and 202*b*, respectively, is bottom mounted to a bottom surface of an opposing floor unit. In this illustration, section 202*a* is of slightly greater lateral extent than section 202*b*. This provides for lower arm 206*a* and lower arm 206*b* of each angular s-shaped section 202*a* and 202*b*, respectively, to overlap. Overlapping sections, slightly spaced provide for easier installation, and more importantly, for expansion and contraction of the protection device. If additional protection is desired, layer 208 comprising an insulation blanket material may be inserted between the outermost layer of the fire barrier of the barrier/retainer structure and protection device 200. FIG. 4, a perspective view, provides a more detailed view of optional fire barrier guard protection device according to the principles this invention.

Figure 5:
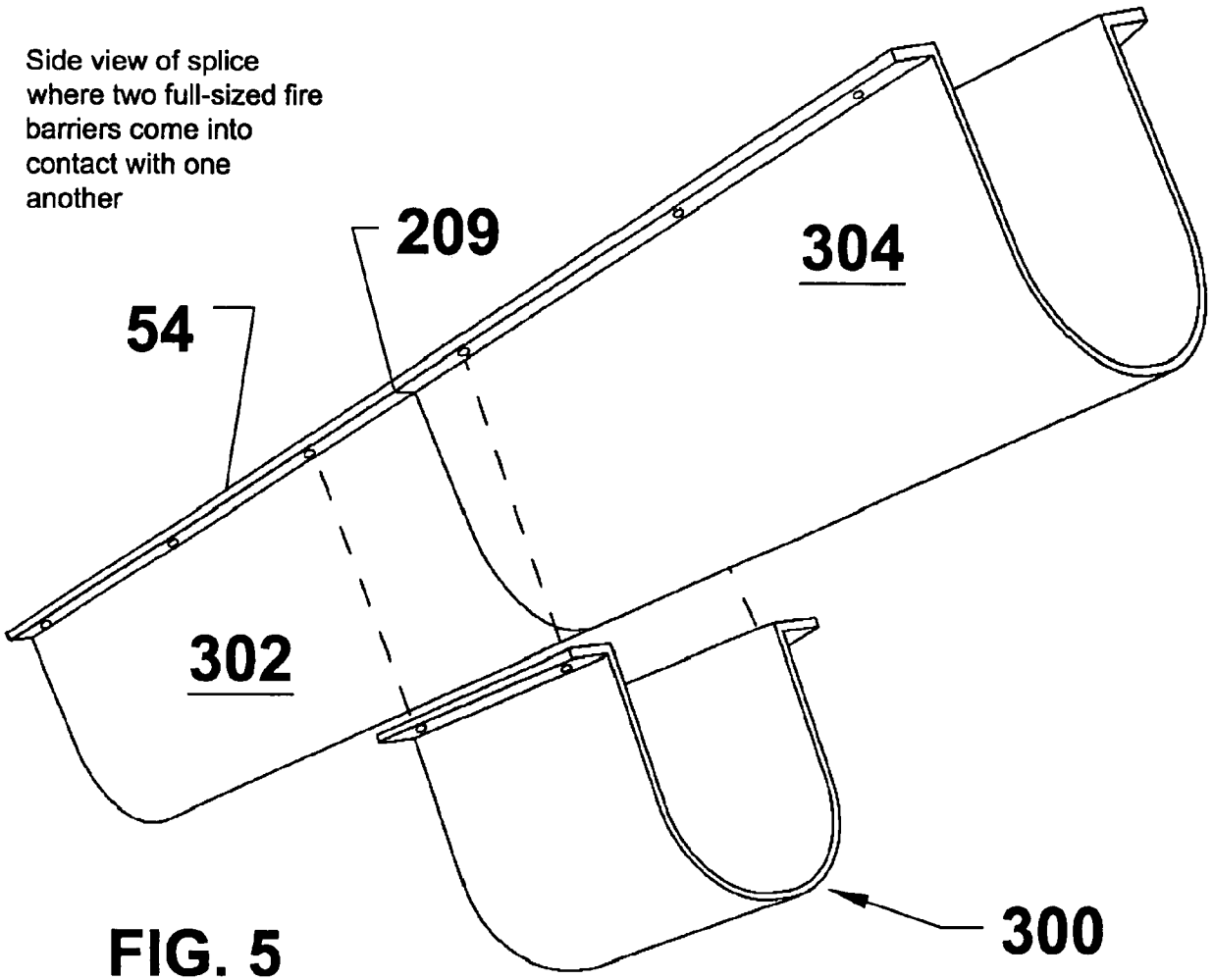
FIG. 5 is a perspective view of a splice connector used to connect two abutting straight-line fire barrier sections, according to the principles of the present invention.

FIG. 5, a perspective view, illustrates splice connector 300 used to assist in connecting abutting straight-line fire barrier sections, such as, for example, sections 302 and 304, according to the principles of the present invention. For the sake of clarity, details of the retainer and barrier as shown in FIGS. 1-3, have been omitted, leaving only retainer arms 54 illustrated. It is to be understood, however, that splice connector 300 and sections 302 and 304 are constructed following the principles of the construction of the fire barrier/retainer of the present invention, as illustrated in FIGS. 1-3. To use splice connector 300 to cover, strengthen, and protect splice connection line 209 indicating the splice of sections 302 and 304, the connector has only to be lifted in place and fastened using any means of fastening that will hold the sections together in a tight and secure fit, such connections can be pins, screws, staples, and the like. Fire caulk is then applied over the seam. It should also be understood that all fire barrier sections, such as sections 302 and 304, may be constructed with male and female ends (refer to FIG. 5*a*) and in this instance, the use of a splice connector is optional, but the use of fire caulk is still employed.

Figure 5A:
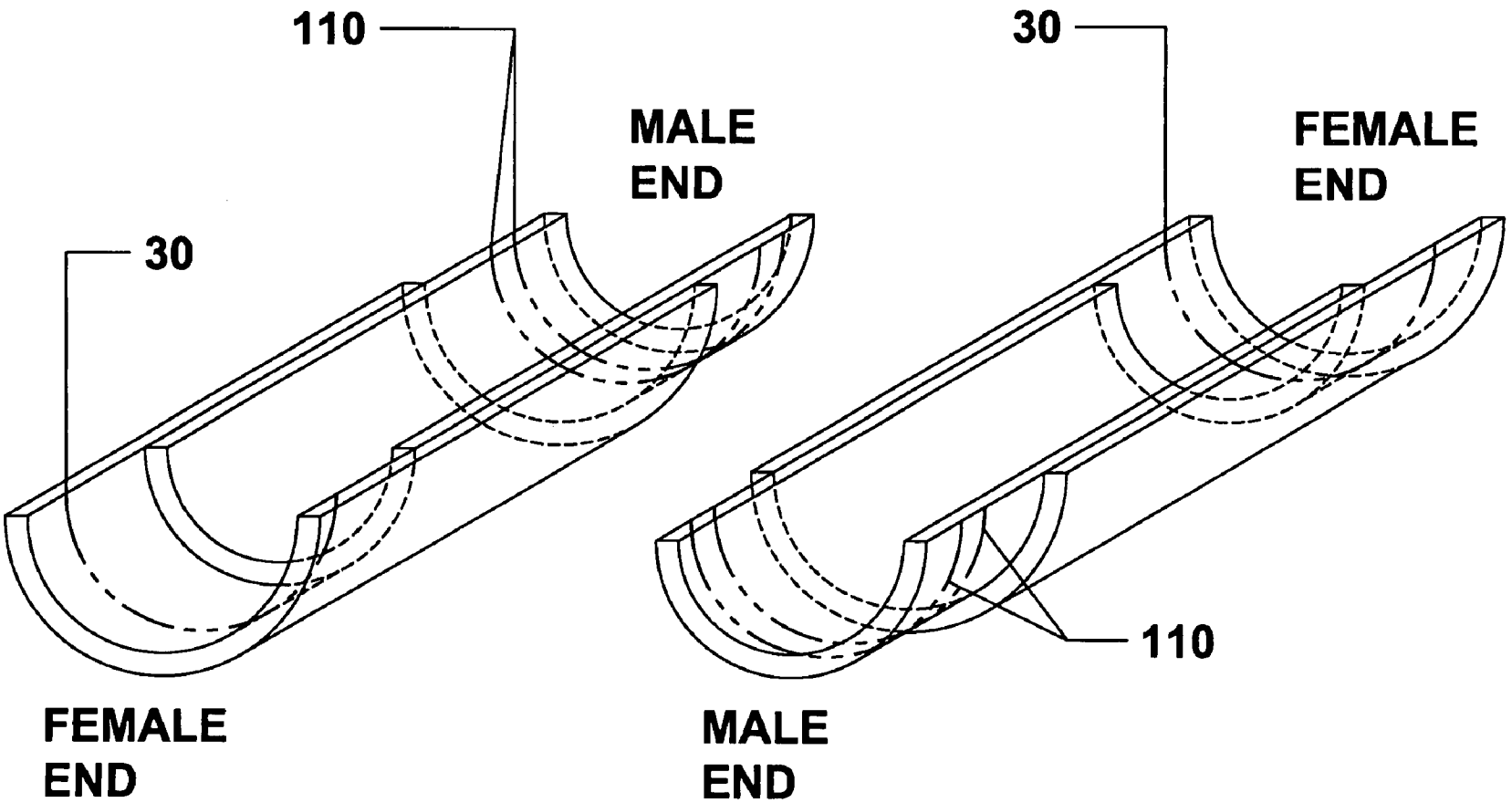

FIG. 5A, a perspective view, illustrates a male to female connection design. Note intumescent stripping 110 on the outside of the male end and fire resistant caulk 30 on the inside of the female end. Again, for the sake of clarity, details of the retainer and barrier as shown in FIGS. 1-3, have been omitted, the end connections of the fire barrier/retainer structure illustrated. It is to be understood, however, that fire barrier/retainer structures having male/female connecting ends are constructed following the principles of the construction of the fire barrier/retainer of the present invention, as illustrated in FIGS. 1-3.

What is claimed is:

1. A fire barrier system, comprising:

a bottom mount fire barrier/retainer system affixable to underside surfaces of preexisting spaced opposing building units forming an expansion joint space, comprising:

a fire barrier having a length having a top surface and a bottom surface, a first long side, a second long side, and a middle section draped there between and, fire resistant metal retainers comprising, a first retainer flange (54) having a top surface and a bottom surface directly on said top surface of said first long side of the barrier providing for said top surface of said first flange to be attached to the pre-existing underside surface of one building unit;

a second retainer flange (54) having a top surface and a bottom surface directly on said top surface of said second long side of the barrier providing for said top surface of said first flange to be attached to the pre-existing underside surface of the opposing building unit;

an integral third retainer flange (55) directly on an adjacent section of said to surface of said first long side of a layer of said fire barrier;

an integral fourth retainer flange (55) directly on an adjacent section of said top surface of said second long side of said layer of said fire barrier, and attachment devices (160) to be inserted into said bottom surface of said fire barrier to penetrate through said fire barrier and said flanges attaching said fire barrier/retainer system to the underside surfaces of the spaced opposing pre-existing building units, protecting said flanges from fire occurring below said building units.

2. The fire barrier/retainer system, as recited in claim 1, wherein each of said first and second retainers further comprises a second retainer flange (52) extending into the expansion joint space in a generally opposing direction from said third flange (55).

3. The fire barrier/retainer system, as recited in claim 1, further comprising a fire-resistant fire barrier protection cover affixed to the bottom surface of each of said opposing building units forming the expansion joint space so as to cover the underside of the fire barrier that extends beneath the expansion space.

4. The fire barrier/retainer system, as recited in claim 1, wherein said fire barrier/retainer structure further comprises a connecting fire resistant fire barrier splice line protector cover to connect and protect a splice area of abutting fire barrier sections comprising a U-shaped piece of fire resistant material that is shaped to snugly fit over the splice line about the outer surface of the splice.

5. The fire barrier/retainer system, as recited in claim 1, wherein said fire barrier/retainer structure further comprises fire barrier sections comprising male and female splice connecting ends that do not require said splice cover.

6. The fire barrier/retainer system, as recited in claim 1, wherein said fire barrier further comprises an outermost fire resistant protective cloth overlain by a sheet of stainless steel foil, followed by a layer of insulation blanket with an intumescent material used at ends and joins.

7. The fire barrier/retainer system, as recited in claim 1, where each of said retainer parts is a single elongate construct having a length, said length having a width, where the length is the length of the fire barrier and the width is defined as comprising the first flange part (54) attachable to the first long side of the barrier and the second flange part (53) that is an opposing extension of the first flange (54) part and is of sufficient width to extend into the extension joint space to provide a lifting support for an installation tool.

8. The fire barrier/retainer system, as recited in claim 1, wherein each of said retainers further comprises a four arm cross-sectional profile, where a first retainer arm which is said first flange (54)

a second retainer arm which is said fourth flange (53) a third retainer arm which is said second flange (52) of the same length as the first and second retainer arm extending away from and roughly perpendicular to an area defining the junction of the first and second arm to fit snugly against the building unit defining the expansion joint space to keep the fire barrier in a correct position against the building unit, and a fourth retainer arm which is said flange (55) being an opposing extension of the third arm extending to be in intimate contact with barrier layers so as to support the barrier and the other arms.

* * * * *